US006083086A

United States Patent [19]

Hacikyan

[11] Patent Number: 6,083,086

[45] Date of Patent: Jul. 4, 2000

[54] EXPANDING DEVICE FOR GRINDING SLEEVES

[75] Inventor: Mike Hacikyan, Buffalo, N.Y.

[73] Assignee: Technicor Inc., Buffalo, N.Y.

[21] Appl. No.: 09/267,175

[22] Filed: Mar. 12, 1999

[51] Int. Cl.[7] ..... B24B 1/00

[52] U.S. Cl. ..... 451/59; 505/28

[58] Field of Search ..... 451/59, 495, 504, 451/505; 15/149, 104.17, 104.18, 104.19

[56] References Cited

U.S. PATENT DOCUMENTS

| | | | |
|---|---|---|---|
| 2,458,217 | 1/1949 | Staggs | 51/190 |
| 2,601,048 | 6/1952 | Monger | 51/192 |
| 2,870,582 | 1/1959 | Raske | 51/192 |
| 2,971,765 | 2/1961 | Atherholt, Sr. | 279/4 |
| 3,232,011 | 2/1966 | Pineau | 51/373 |
| 3,496,685 | 2/1970 | Schmidt et al. | 51/373 |
| 3,977,127 | 8/1976 | Mahnken | 51/5 R |
| 4,229,014 | 10/1980 | Crowe | 279/2 |
| 4,897,968 | 2/1990 | Hutt | 51/373 |
| 5,185,970 | 2/1993 | Fiocchi | 51/372 |
| 5,351,447 | 10/1994 | Grauert | 451/505 |
| 5,672,096 | 9/1997 | Amarosa, Sr. et al. | 451/504 |

*Primary Examiner*—Timothy V. Eley
*Assistant Examiner*—Dung Van Nguyen
*Attorney, Agent, or Firm*—Hodgson, Russ, Andrews, Woods & Goodyear LLP

[57] ABSTRACT

The present invention is an expanding device for supporting grinding sleeves. The device has a cylindrical member with an outer surface, an interior chamber, an expanding chamber, and a locking mechanism. The outer surface receives the grinding sleeve and has a first outer diameter of D. The interior chamber receives a rotatable shaft and has a second outer diameter of I, which is less than D. The expanding chamber comprises an expanding material that expands and contracts based upon pressure applied thereon and has a third outer diameter of H and an inner diameter of J, wherein H and J are both greater than I and less than D. The locking mechanism has an open position and a closed position and requires no hand tool to alter its position. When the locking mechanism is in the open position the locking mechanism applies a pressure P to the expanding chamber so the first outer diameter is D, the second outer diameter is I, the third outer diameter is H, and the inner diameter is J. In contrast, when the locking mechanism is in the closed position the locking mechanism applies a pressure Z, which is greater than P, to the expanding material so the first outer diameter and the third outer diameter expand, and the second outer diameter and inner diameter contract.

4 Claims, 4 Drawing Sheets

EXPANDING DEVICE FOR GRINDING SLEEVES

FIELD OF THE INVENTION

The present invention relates to an expanding device to support grinding sleeves.

BACKGROUND OF THE INVENTION

Fiocchi in U.S. Pat. No. 5,185,970 discloses a conventional expanding device for supporting grinding sleeves. The expanding device has "a shaped shaft which concentrically supports a plurality of mutually facing disks which can slide in an axial direction and which are rigidly rotationally connected with the shaft. The disks define, between one another in cooperation, a plurality of peripheral seats for the accommodation of elastic rings which can expand radially upon the axial compression of the disks. The elastic rings are suitable for engaging the inner surface of an emery cloth sleeve." Abstract of U.S. Pat. No. 5,185,970.

A hand tool must be used to adjust that shaft which in turns expands or contracts those elastic rings. For some people, hand tools are difficult to use for such small objects. The present invention solves this problem.

Those elastic rings contact that sleeve since they are on the outer surface of the expanding device. By having those rings on the outer surface, they can be damaged by the use of the sleeve or the pressure applied by those disks that apply pressure to those rings. The present invention also solves this problem.

SUMMARY OF THE INVENTION

The present invention is an expanding device for supporting grinding sleeves. The device has a cylindrical member with an outer surface, an interior chamber, an expanding chamber, and a locking mechanism. The outer surface receives the grinding sleeve and has a first outer diameter of D. The interior chamber receives a rotatable shaft and has a second outer diameter of I, which is less than D. The expanding chamber comprises an expanding material that expands and contracts based upon pressure applied thereon and has a third outer diameter of H and an inner diameter of J, wherein H and J are both greater than I and less than D. The locking mechanism has an open position and a closed position and requires no hand tool to alter its position. When the locking mechanism is in the open position the locking mechanism applies a pressure P to the expanding chamber so the first outer diameter is D, the second outer diameter is I, the third outer diameter is H, and the inner diameter is J. In contrast, when the locking mechanism is in the closed position the locking mechanism applies a pressure Z, which is greater than P, to the expanding material so the first outer diameter and the third outer diameter expand, and the second outer diameter and inner diameter contract.

DETAILED DESCRIPTION OF THE PRESENT INVENTION

Figure 1:
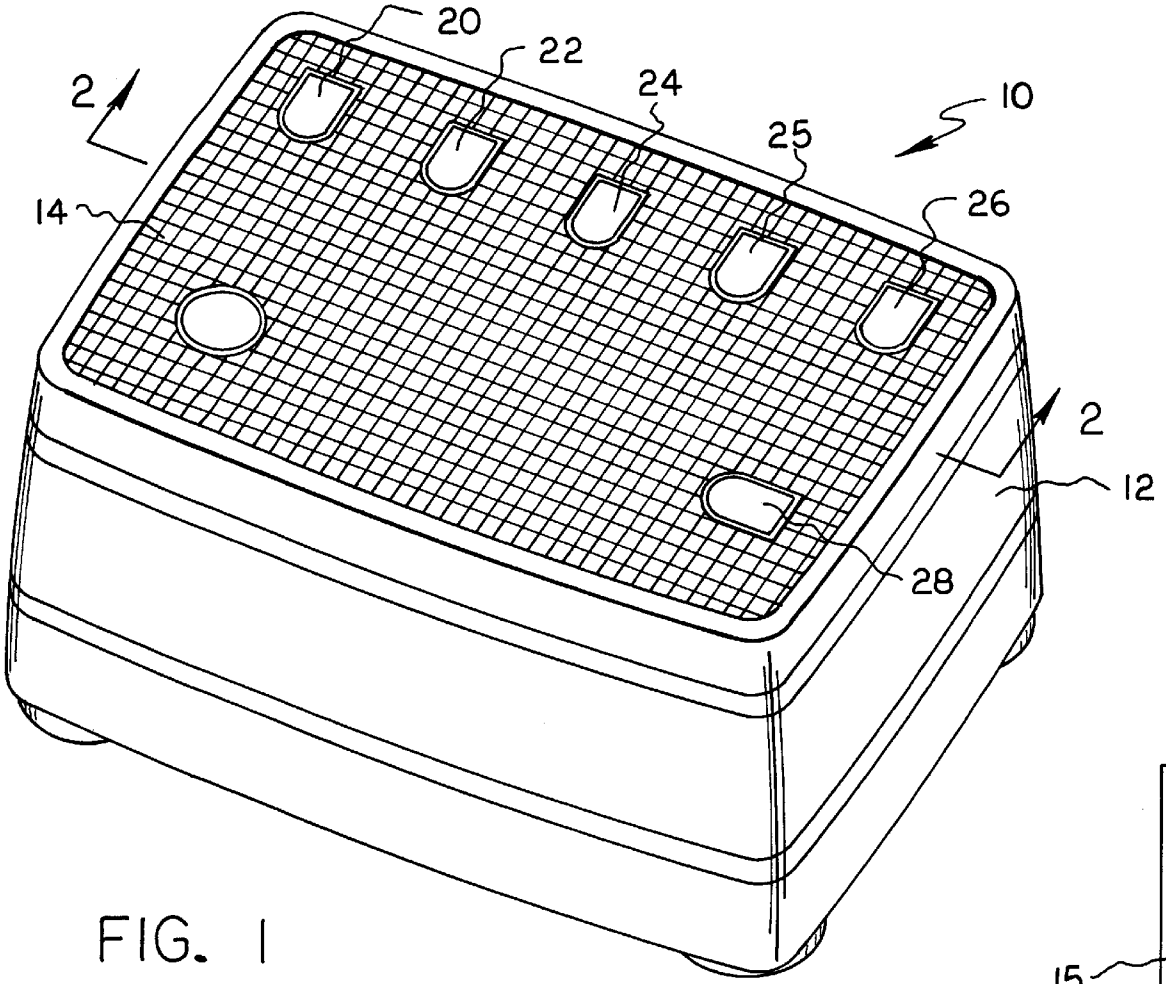
FIG. 1 is a perspective view of the grinding apparatus.

FIG. 1 shows one embodiment of a multi-purpose grinding machine 10. The machine 10 includes a housing 12 having a grid-like top 14. A dividing platform 15, located within the housing 12, is parallel to the top 14. The top 14 has a plurality of openings 20, 22, 24, 25, 26, and 28 formed therein through which driven spindles 30, 32, 34, 35, 36, and 38 extend.

Figure 3:
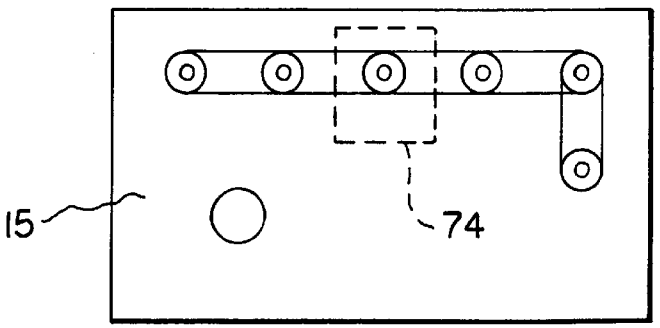
FIG. 3 is a diagrammatic plan view showing the interior of FIG. 1.
Figure 2:
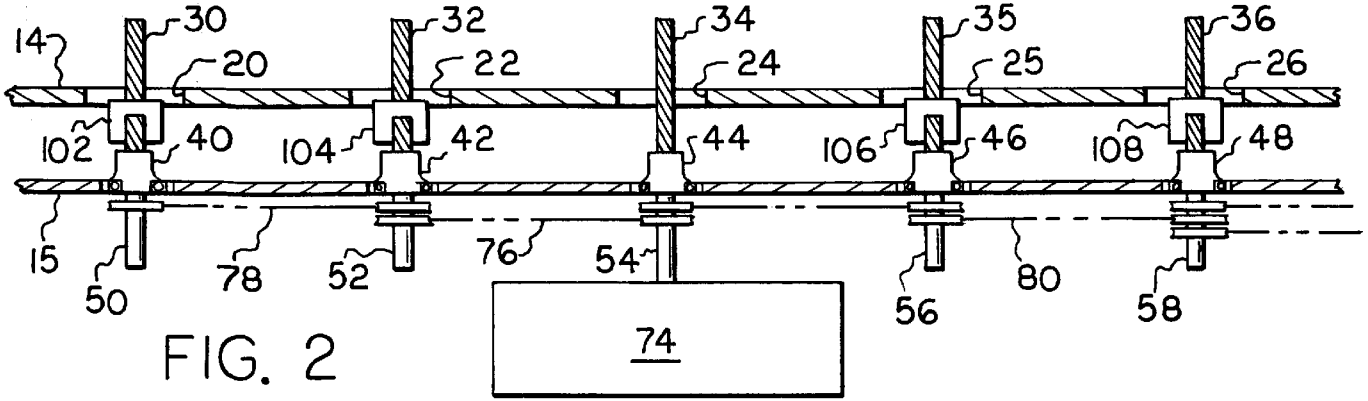
FIG. 2 is a cross-sectional view of FIG. 1 taken along the lines 2—2 of FIG. 1.
Figure 5:
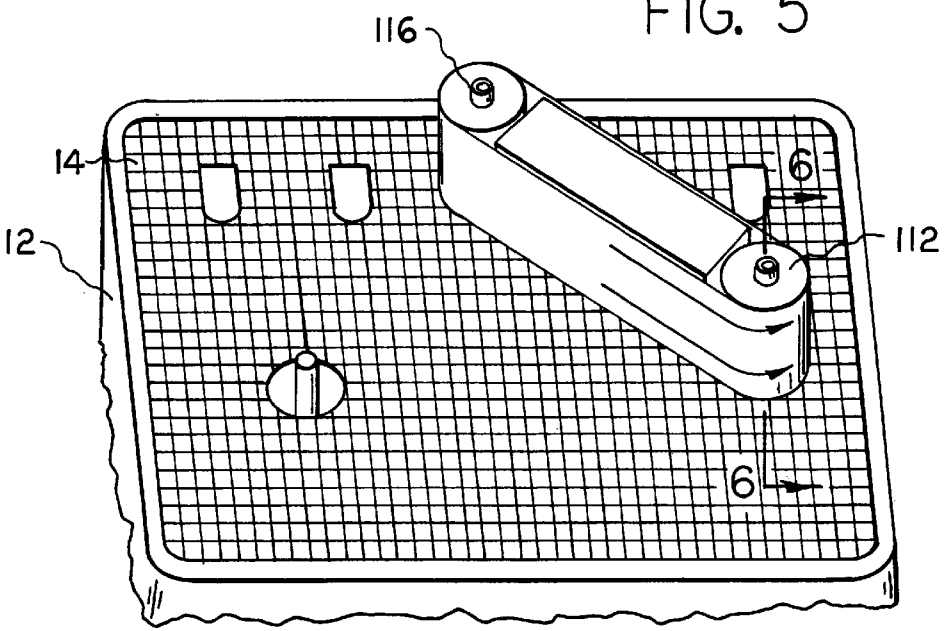
FIG. 5 is a diagrammatic perspective showing how the unit is used as a sander/grinder apparatus.
Figure 4:
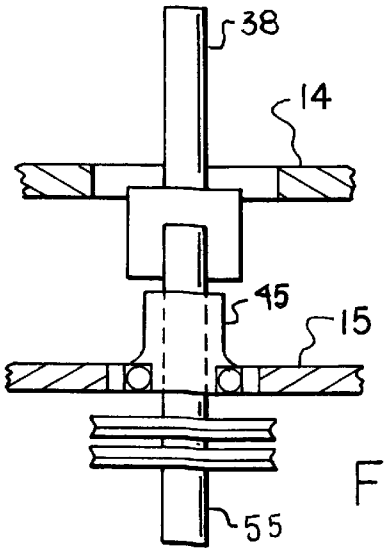
FIG. 4 is an enlarged view of one of the spindle drive assemblies.

The platform 15 is equipped with openings immediately below the aforementioned openings. Each opening receives a bearing 40, 42, 44, 45, 46, and 48. These bearings rotatably support driven shafts 50, 52, 54, 55, 56, and 58. Each of the lower driven shafts 50, 52, 54, 55, 56, and 58 is equipped with a sheave assembly respectively. The shaft 54 is driven directly by a single motor 74. As seen in the diagrammatic plan view of FIG. 3, and with reference to FIG. 2, it can be seen that shaft 52 is driven by a belt or drive link 76 and shaft 50 is driven by a belt or drive link 78 that extends between the sheaves 62 and 60. The shaft 56 is connected to the drive shaft 54 by belt or drive link 80. The lower shaft 54 is connected to shaft 58 by belt or drive link 80. The offset shaft 58 is connected to the driven shaft 58 by way of belt or drive link 82. All of the above drives are accomplished by the belt and sheave mechanisms.

The upper ends of lower shafts 50, 52, 54, 55, 56, and 58 extend upwardly to a level below the openings 20, 22, 24, 25, 26, and 28. Connected to the upper ends of these shafts are spindles 30, 32, 34, 35, 36, and 38. The spindles 30, 32, 34, 35, 36, and 38 secure to the lower shafts by quick disconnects or drop-on collars 102, 104, 106, and 108.

The grid 14 has apertures between the ridges thereof that permit grinding fluids and/or ground material to fall into the interior of the machine. The openings 20, 22, 24, 25, 26, and 28 are in addition to these apertures. These openings are also closed by lids 120 when not in use.

There has been described a grinding cabinet having a single motor 74. This motor drives a lower shaft 54 directly. In turn, the lower spindle drives an upper spindle 34 through a bearing 44. Each of the lower shafts are equipped with a sheave assembly for transmitting power to all of the driven shafts. This permits a plurality of tools and cutting equipment to be mounted thereon in the conventional fashion. A workpiece can then be processed with significant time-saving and accuracy because the worker can move from one tool to another without a shutdown in operation. All of this is accomplished through the use of the single motor.

Figure 6:
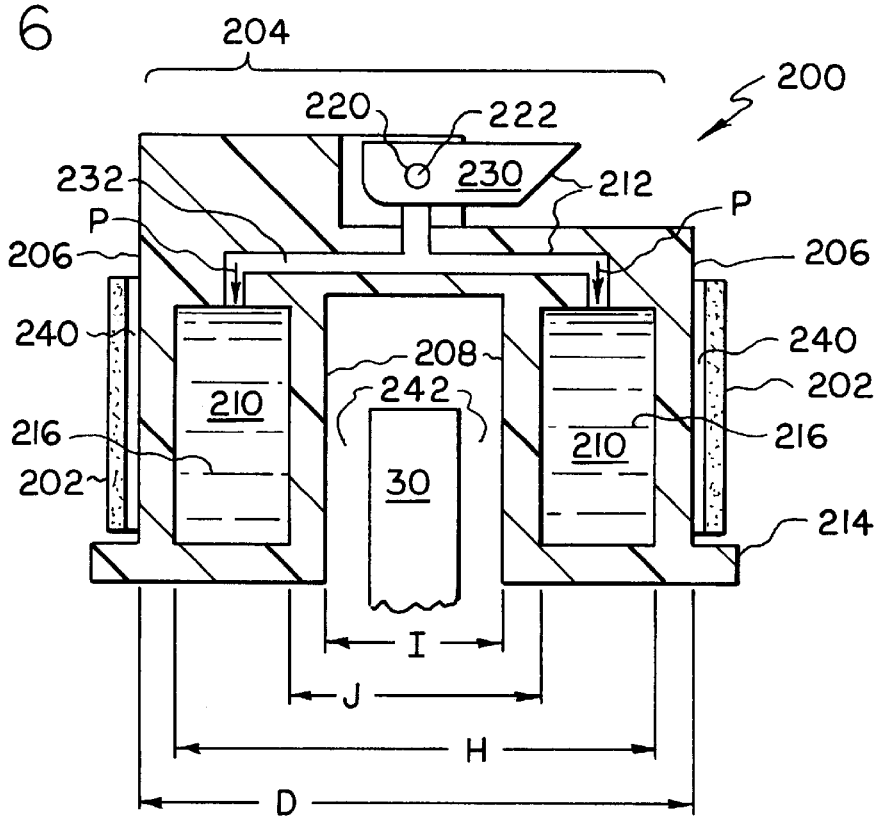
FIG. 6 is a cross-sectional view of an expanding device in the open position.

Turning to FIG. 6, the present invention also relates to an expanding device 200 for supporting grinding sleeves 202. The device 200 is a cylindrical member 204 with an outer surface 206, an interior chamber 208, an expanding chamber 210, and a locking mechanism 212.

The outer surface 206 receives the grinding sleeve 202. The outer surface 206 has a first outer diameter of D that receives the sleeve 202 and a ledge 214 to ensure the sleeve 202 does not fall off the device 200.

The interior chamber 208 receives a rotatable shaft 30. The chamber 208 has an outer diameter of I, which is less than D. The outer surface 206 and interior chamber 208 are made of materials that expand when a pressure is applied to them. Examples of these expandable materials include plastic and certain alloys known to those skilled in the art.

The expanding chamber 210 comprises an expanding material 216 that expands and contracts based upon pressure applied thereon. Examples of the expanding material 216 include, and not limited to, water, rubber, polyethylene and other known expandable polymers water-based solutions and oil-based solutions. The chamber 210 has an outer diameter of H and an inner diameter of J, wherein H and J are both greater than I and less than D.

Figure 7:
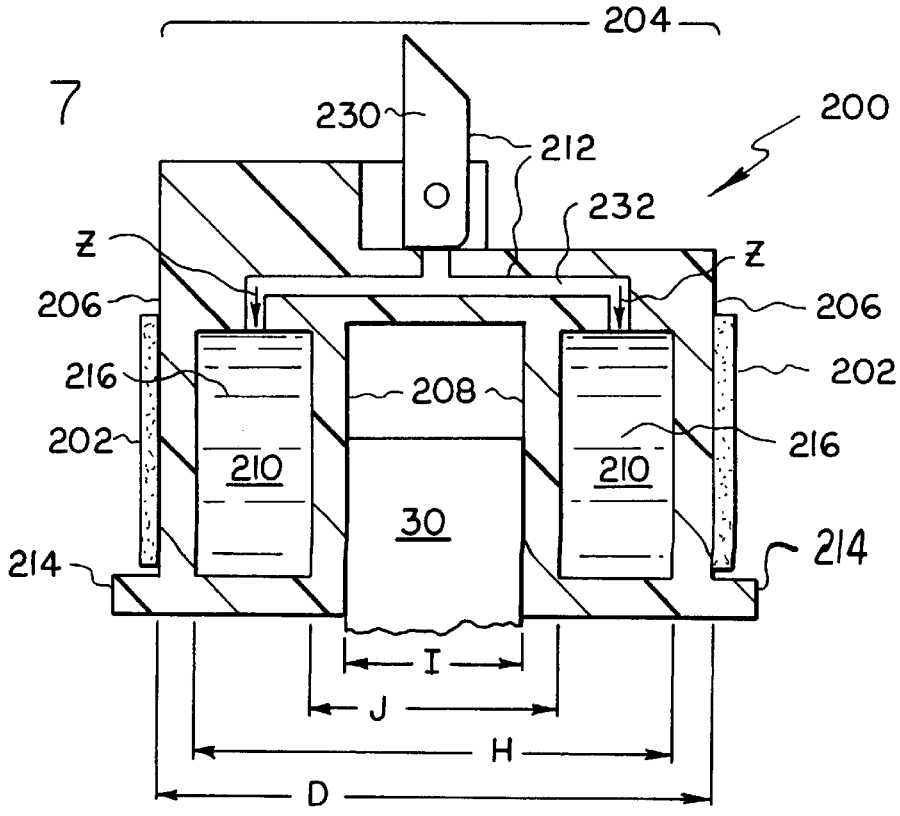
FIG. 7 is a cross-sectional view of an expanding device in the closed position.

The locking mechanism 212 has an open position, as shown in FIG. 6, and a closed position, as shown in FIG. 7, and requires no hand tool to alter between the two positions. The locking mechanism 212 has two components, an upper component 230 and a lower component 232. The upper component 230, in one embodiment, is a locking lever with a cam actuator with a locking detent that rotates about pivot point 220. Pivot point 220 has a securing mechanism 222, such as a bolt pin, a rivet, or a screw, that secures the locking mechanism 212 to the device 200 and allows the upper component 230 to rotate about the pivot point 220 into the open or closed position.

When the locking mechanism 212 is in the open position, the lower portion 232 is an internal plunger, applies a pressure P to the expanding material 216. In the open position, the outer diameter of the outer surface 206 is D, the outer diameter of the interior chamber is I, the outer diameter of the expanding chamber is H, and the inner diameter of the expanding chamber is J. With those diameters, the device 200 receives the grinding sleeve 202 since there is a first gap 240 between the sleeve 202 and the outer surface 206, and the rotatable shaft 30 receives the device 200 since there is a second gap 242 between the outer diameter of the interior chamber 208 and shaft 30.

The grinding sleeve 202 can be sandpaper, diamond, emery cloth or any conventional material that grinds metal, wood, or plastic materials. The grinding sleeve 202 is cylindrical or any other shape that fits upon one size of device 200.

Turning to FIG. 7, when the locking mechanism 212 is in the closed position the lower component 232 applies a pressure Z, which is greater than P, to compress the expanding material 216. In the closed position, the compressed expanding material 216 forces the outer diameter of the outer surface 206 and the outer diameter of the expanding chamber 210 to expand in order to secure the grinding sleeve 202 to the outer surface 206 with little to no gap 240. The expanding material 216 in the closed position also forces the outer diameter of the interior chamber and inner diameter of the expanding chamber to contract in order to secure the cylindrical member 204 to the rotating shaft 30 with little to no gap 242.

Figure 8:
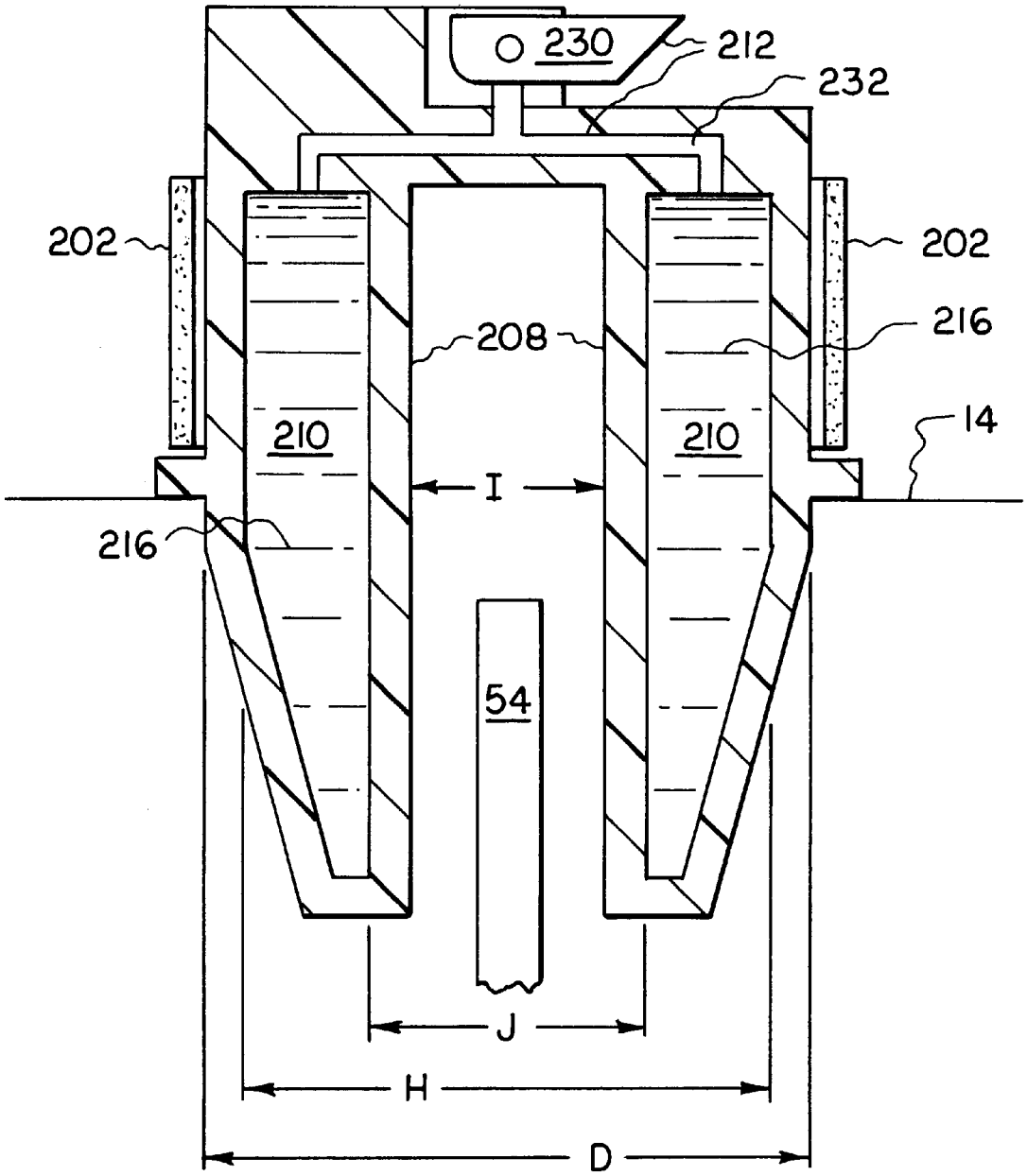
FIG. 8 is an alternative version of FIG. 7.

FIG. 8 shows an alternative embodiment of FIG. 7, wherein the device 200 has an extension 250 to connect to the submerged shaft 54.

Numerous variations will occur to those skilled in the art. It is intended therefore, that the foregoing descriptions be only illustrative of the present invention and that the present invention be limited only by the hereinafter appended claims.

What is claimed is:

1. A method of securing a grinding sleeve to an expanding device comprising the steps of:

placing a cylindrical member upon the rotatable shaft wherein the cylindrical member has an outer surface, an interior chamber, an expanding chamber, and a locking mechanism, the outer surface receives the grinding sleeve and has a first outer diameter of D, the interior chamber receives a rotatable shaft and has a second outer diameter of I, which is less than D, the expanding chamber has a third outer diameter of H and an inner diameter of J wherein H and J are both greater than I and less than D, and comprises an expanding material that expands and contracts based upon pressure applied thereon, and the locking mechanism has an open position and a closed position, the locking mechanism requires no hand tool to alter the open position to the closed position and the closed position to the open position, wherein the locking mechanism is in the open position and applies a pressure P to the expanding chamber so the first outer diameter is D, the second outer diameter is I, the third outer diameter is H, and the inner diameter is J;

sliding the grinding sleeve upon the outer surface wherein the locking mechanism is in the open position and applies a pressure P to the expanding chamber so the first outer diameter is D, the second outer diameter is I, the third outer diameter is H, and the inner diameter is J;

positioning the locking mechanism into the closed position so the locking mechanism applies a pressure Z, which is greater than P, to the expanding material which forces a) the first outer diameter and the third outer diameter to expand which results in the grinding sleeve being secured to the outer surface, and b) the second outer diameter and inner diameter to contract which results in the cylindrical member being secured to the rotating shaft.

2. The method of claim 1 further comprising the step of positioning the locking mechanism into the open position so the locking mechanism applies the pressure P to the expanding chamber so the first outer diameter reverts to D, the second outer diameter reverts to I, the third outer diameter reverts to J and the inner diameter reverts to H, to release the grinding sleeve from the cylindrical member and the cylindrical member from the rotating shaft.

3. The method of claim 1 wherein the expanding material is selected from a group consisting of water, rubber, polyethylene, water-based solutions and oil-based solutions.

4. The method of claim,1 wherein the locking mechanism requires no hand tool to alter between the open and closed positions.

* * * * *